US010161202B2

(12) United States Patent
Koehler et al.

(10) Patent No.: US 10,161,202 B2
(45) Date of Patent: Dec. 25, 2018

(54) DRILL ROD STORE, DRILLING RIG AND METHOD FOR DOWNWARD DRILLING

(71) Applicant: BAUER Deep Drilling GmbH, Schrobenhausen (DE)

(72) Inventors: Rainer Koehler, Neuhaus-Schnierschnitz (DE); Manuel Peter Ostermeier, Pobenhausen (DE)

(73) Assignee: BAUER Deep Drilling GmbH, Schrobenhausen (DE)

( * ) Notice: Subject to any disclaimer, the term of this patent is extended or adjusted under 35 U.S.C. 154(b) by 120 days.

(21) Appl. No.: 15/404,573

(22) Filed: Jan. 12, 2017

(65) Prior Publication Data

US 2018/0195352 A1 Jul. 12, 2018

(51) Int. Cl.
*E21B 19/14* (2006.01)
*E21B 19/15* (2006.01)

(52) U.S. Cl.
CPC ..... *E21B 19/15* (2013.01)

(58) Field of Classification Search
CPC ..... E21B 19/14; E21B 19/146; E21B 19/15; E21B 19/155
See application file for complete search history.

(56) References Cited

U.S. PATENT DOCUMENTS 3,145,786 A * 8/1964 O'Neill ..... E21B 19/15 173/28
3,780,883 A * 12/1973 Brown ..... E21B 19/15 175/85
2006/0045655 A1 3/2006 Wells
2007/0031215 A1 2/2007 Belik

FOREIGN PATENT DOCUMENTS

EP 1 746 247 A2 1/2007

* cited by examiner

*Primary Examiner* — Cathleen R Hutchins
(74) *Attorney, Agent, or Firm* — Studebaker & Brackett PC

(57) ABSTRACT

The invention relates to a drill rod store having a first storage area and a second storage area, in which a plurality of drill rod elements are in each case stored in horizontal alignment. Between the two storage areas a trough-shaped receiving part for a single drill rod element is provided. The trough-shaped receiving part is designed to deliver a single drill rod element. For this purpose, a joint supply means is provided, through which drill rod elements are supplied both from the first storage area and from the second storage area to the trough-shaped receiving part.

13 Claims, 10 Drawing Sheets

DRILL ROD STORE, DRILLING RIG AND METHOD FOR DOWNWARD DRILLING

FIELD OF THE INVENTION

The invention relates to a drill rod store having a storage area, in which a plurality of drill rod elements is stored in horizontal alignment, and a trough-shaped receiving part for a single drill rod element which is designed to deliver a single drill rod element.

The invention further relates to a drilling rig with a drill mast for the downward drilling of drill rod elements.

Finally, the invention also relates to a method for the downward drilling of drill rod elements.

BACKGROUND OF THE INVENTION

Especially in the case of oil and gas drilling by means of a drilling rig a plurality of drill rod elements is required to reach great drilling depths. The drill rod elements are stored in large numbers in a drill rod store on the drilling rig. By means of a handling system the drill rod elements are removed and connected to the drill string along a drill mast. By means of a drill drive the drill string is driven further into the ground by the length of the newly added drill rod element. Afterwards, a further drill rod element is removed from the drill rod store and added to the drill string. This is repeated until a desired drilling depth has been reached.

From EP 1 746 247 A2 a drilling rig with a drill rod store is known which has a horizontal storage area for the drill rod elements. Here, the drill rod elements are stored lying horizontally next to each other.

To remove a single drill rod element a first drill rod element is raised, thereby allowing it to roll along a rail to a receiving lever. By pivoting the receiving lever the drill rod element is placed into a trough-shaped receiving part. From there the drill rod element can be received by the handling system, pivoted into a vertical position and added to the drill string.

A similar drilling rig with a comparable drill rod store is known from US 2007/0031215 A1.

Furthermore, from US 2006/0045655 A1 a drilling rig with a drill rod store can be taken, in which the drill rods are also arranged in horizontal alignment next to each other in a storage area. To remove a single drill rod element a pivot lever with a concave recess is provided, which is adapted to the cylindrical shape of the drill rod element. By lowering the pivot lever a drill rod element can thus roll into the concave recess. Afterwards, the pivot lever is pivoted by approximately 90° from a horizontal starting position into a vertical starting position. In this position the drill rod element can roll from the concave recess of the pivot lever into a trough-shaped receiving part, from which the drill rod element is supplied via the handling system to the drill string on the drill mast.

SUMMARY OF THE INVENTION

The invention is based on the object to provide a drill rod store, a drilling rig and a method for the downward drilling of drill rod elements which enable a particularly efficient delivery of a single drill rod element from a storage area.

In accordance with the invention the object is achieved by a drill rod store having a first storage area, in which a plurality of drill rod elements are stored in horizontal alignment, a second storage area, in which a plurality of drill rod elements are stored in horizontal alignment, a trough-shaped receiving part for a single drill rod element, wherein the trough-shaped receiving part is arranged between the first storage area and the second storage area and is designed to deliver a single drill rod element, and a joint supply means which is designed to supply drill rod elements both from the first storage area and from the second storage area to the trough-shaped receiving part.

A basic idea of the invention resides in the fact that two storage areas are provided separate from each other, between which a joint trough-shaped receiving part is provided for receiving a single drill rod element. To remove a drill rod element from either the first storage area or the second storage area a joint supply means is arranged. This reduces the complexity of the device for handling the drill rod elements. Moreover, by arranging two separate storage areas on both sides a large number of drill rod elements can be stored directly on a drilling rig.

A preferred embodiment of the invention resides in the fact that at least one of the two storage areas has at least two support rails which are directed towards the trough-shaped receiving part and designed to support the drill rod elements parallel to the trough-shaped receiving part. On the two or more support rails the stored drill rod elements can be displaced or moved with low friction.

According to a further development of the invention it is especially preferred that the support rails are arranged in an inclined manner to the trough-shaped receiving part. By preference, an angle of inclination ranges between 3° and 45° with respect to the horizontal. In this way, the drill rod elements can roll on the support rails under the effect of gravity right up to the trough-shaped receiving part. A separate feed drive may be provided but is not necessary in this arrangement.

Moreover, according to an embodiment variant of the invention it is preferred that the trough-shaped receiving part has a lateral first marginal edge and a lateral second marginal edge, wherein the first marginal edge is arranged above the support rails of the first storage area and between the support rails of the first storage area and the first marginal edge an arched rail element is arranged in each case and wherein the second marginal edge is arranged above the support rails of the second storage area and between the support rails of the second storage area and the second marginal edge an arched rail element is arranged in each case. The transition area between the support rails and the respective adjoining marginal edge is formed by one or several arched rail elements as transition part. In combination with the supply means a drill rod element can thus be conveyed along the upward-directed rail element in the upward direction and over the respective marginal edge. Subsequently, the raised drill rod element can roll from the marginal edge into a center section of the receiving part according to the V-shaped inclination of the trough-shaped receiving part. This enables a reliable separation of drill rod elements during removal from the storage area of the drill rod elements.

Furthermore, according to an embodiment of the invention it is preferred that the supply means has at least one pivot bracket with a first bracket arm and a second bracket arm, wherein the pivot bracket is supported in a pivotable manner about a pivot axis which is directed parallel to the trough-shaped receiving part. Preferably, the pivot bracket with the two bracket arms is designed symmetrically to a center plane of the drill rod store. In this way, the pivot bracket can be used to supply drill rod elements both from the first storage area and from the opposite second storage area.

It is particularly preferred that the pivot axis of the at least one pivot bracket runs below the trough-shaped receiving part and centrally thereto. By preference, several pivot brackets can be provided such that they are spaced axially from each other. Especially when handling relatively long drill rod elements several pivot brackets prove to be useful for a uniform application of force.

Another preferred embodiment of the invention resides in the fact that each bracket arm of a pivot bracket has a lifting surface which is inclined towards the trough-shaped receiving part and designed to raise a drill rod element from the storage area over the lateral marginal edge of the trough-shaped receiving part. In a transfer position the lifting surface is provided with an angle of inclination ranging between 3° and 45° to the horizontal. This makes it possible that in the transfer position a raised drill rod element can roll at the height of or above the adjoining marginal edge from the oblique lifting surface into the trough-shaped receiving part. In particular, the size of the lifting surface is dimensioned such that at least in the transfer position only a single drill rod element is located on the lifting surface. Through this, a reliable separation during removal from a plurality of drill rod elements is achieved.

In this connection a preferred embodiment variant of the invention resides in the fact that each bracket arm of a pivot bracket has a return surface which is inclined to the respective adjoining storage area. The return surface directly adjoins the lifting surface. For example, if two or more drill rod elements are initially raised by the lifting surface of the pivot bracket, the effective lifting surface is reduced by a pivoting movement with respect to the adjacent arched rail element which is stationary so that excess drill rod elements roll from the lifting surface across the return surface back into the storage area. Due to this arrangement the supply means can also be used for different drill rod elements with varying diameters without any major adaptation measures.

According to a further development of the invention it is advantageous that the pivot bracket has a resting position, in which the lifting surfaces of the bracket arms are arranged below the drill rod elements in the storage areas, the pivot bracket can be pivoted from the resting position into a first transfer position, wherein by means of a first lifting surface of a first bracket arm a drill rod element from the first storage area is raised and lifted over the lateral first marginal edge of the trough-shaped receiving part, and the pivot bracket can be pivoted from the resting position into a second transfer position, wherein by means of the second lifting surface of a second bracket arm a drill rod element from the second storage area is raised and lifted over the lateral second marginal edge of the trough-shaped receiving part.

Due to this simple symmetrical design of the pivot bracket an easy transfer operation both from the first storage area and from the second storage area can take place by means of a simple pivoting movement. As a result, a compact and low-maintenance construction of the drill rod store with a separation device is attained on the whole.

Moreover, according to an embodiment variant of the invention it is advantageous that the pivot bracket can be pivoted by means of a pivot drive, in particular a hydraulic cylinder. The pivot drive can be actuated by a control such that on the whole a single transfer operation is effected from the first storage area or the second storage area.

For further handling of the drill rod elements it is advantageous in accordance with a further development of the invention that along the trough-shaped receiving part a slide carriage for axial displacement of a drill rod element is supported and driven in a movable manner. The slide carriage is located in a retracted resting position when the drill rod element is conveyed from the storage area into the trough-shaped receiving part. When the rod element rolls in, it is centered in the trough-shaped receiving part in front of the slide carriage. Through axial displacement of the slide carriage the drill rod element is thus displaced up to a delivery position. In the delivery position the drill rod element can then be gripped by a grab of a drill rod handling system transported to a drill mast with the drill string.

A particularly advantageous further development of the invention resides in the fact that on the trough-shaped receiving part a lifting rod for raising and erecting a drill rod element into a delivery position is supported in a pivotable manner. In particular before a movement of the slide carriage or simultaneously with the movement of the slide carriage a lifting rod is adjusted from a horizontal resting position into an oblique lifting position. Through this, the drill rod element is no longer moved horizontally along the trough-shaped receiving part but erected obliquely upwards into a delivery position. This facilitates a take-over of the drill rod element by a handling system.

The object stated at the beginning is furthermore achieved by a drilling rig with a drill mast for the downward drilling of drill rod elements, wherein a drill rod store according to the invention is provided. The drill rod store forms part of the drilling rig and thus allows an efficient installation and dismantling of a drill string along the drill mast of the drilling rig.

In addition, the invention comprises a method for the downward drilling of drill rod elements, wherein the previously mentioned drilling rig is used. In this method a stepwise downward drilling of the drill string by a length of a drill rod element is effected in each case. After each drilling step a further drill rod element is removed from the drill rod store and supplied via a handling system to the drill mast. The drill rod elements have matching thread sections in their end regions so that a new drill rod element can be connected to the uppermost drill rod element of the drill string already drilled down. Following firm connection of the new drill rod element a further drilling step can be effected by the length of the drill rod element. This work step is repeated until a desired drilling depth has been reached. On completion of the drilling operations the drill string can be withdrawn from the ground in reverse order, wherein the individual drill rod elements are released one after the other from the drill string and returned to a drill rod store.

BRIEF DESCRIPTION OF THE DRAWINGS

In the following the invention is described further by way of preferred embodiments illustrated schematically in the drawings, wherein show.

DETAILED DESCRIPTION OF PREFERRED EMBODIMENTS

Figure 1:
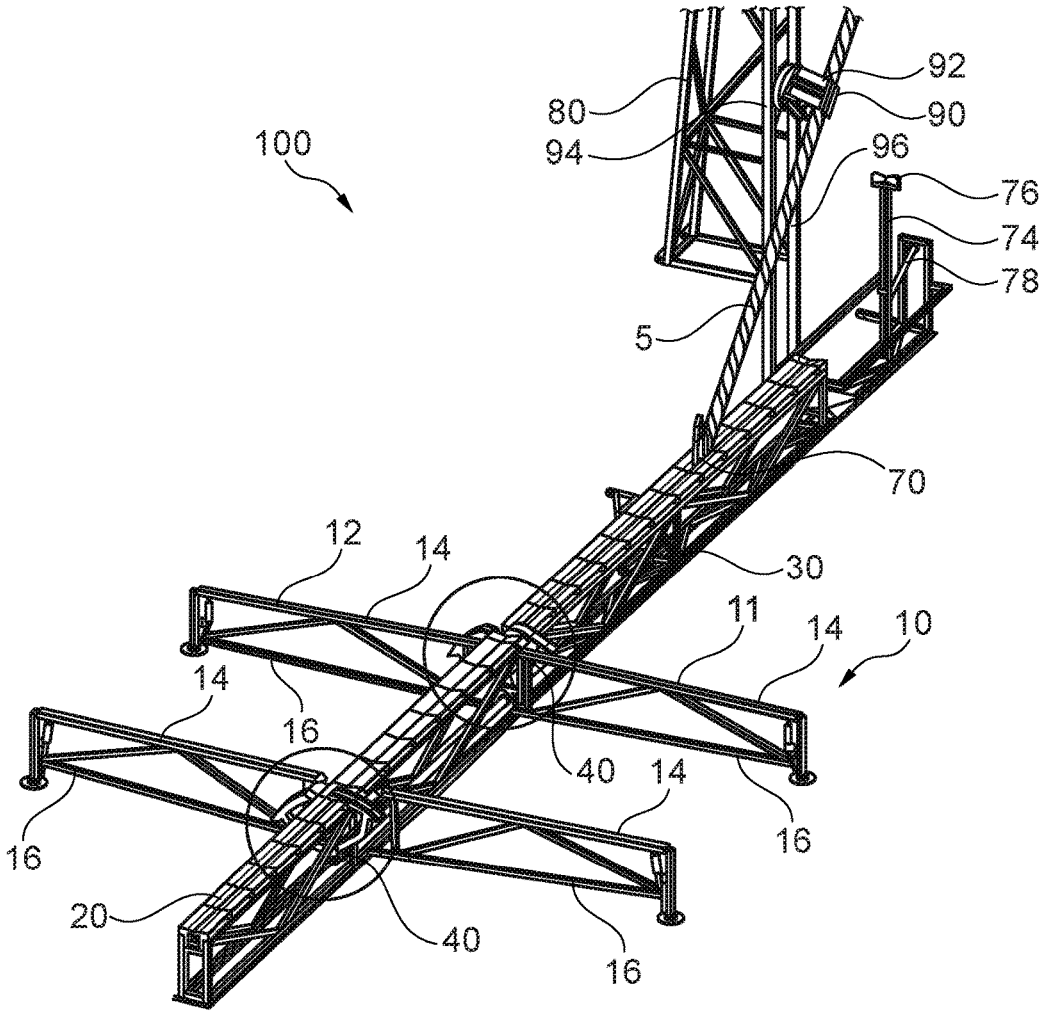
FIG. 1 a perspective partial view of a drilling rig according to the invention.

A drilling rig 100 according to the invention with a drill rod store 10 according to the invention is shown schematically in FIG. 1. The drilling rig 100 has a drill mast 80 which is only depicted partially and schematically and along which a vertically directed drill string of drill rod elements 5 is drilled down into the ground using a drill drive. The drilling rig 100 is provided for oil or gas drilling in particular.

Close to the drill mast 80 a drill rod store 10 with a first storage area 11 and a second storage area 12 is arranged. The two storage areas 11, 12 each have horizontally directed support rails 14 which are each supported on the ground via feet by means of a carrier frame 16. Between the first storage area 11 and the second storage area 12 a trough-shaped receiving part 20 is arranged. On the support rails 14 a plurality of drill rod elements 5, not shown in FIG. 1, are supported parallel to the central trough-shaped receiving part 20. The support rails 14 and the carrier frames 16 of the two storage areas 11, 12 abut laterally on a central carrier structure 30 of steel struts, on the upper side of which the trough-shaped receiving part 20 is designed.

By way of a supply means 40 a drill rod element 5 can be supplied in each case from one of the storages areas 11, 12 to the trough-shaped receiving part 20. Along the trough-shaped receiving part 20 a slide carriage 70 is supported and driven in a linearly movable manner. Through displacement of the slide carriage 70 from a first operating position at an end of the trough-shaped receiving part 20 that is directed away from the drill mast 80 a drill rod element 5 can be moved by the slide carriage 70 in the direction of the drill mast 80 to a second operating position of the slide carriage 70.

During this linear movement of a drill rod element 5 a lifting rod 74 can be moved by an adjusting mechanism 78 with a positioning cylinder from a horizontal resting position into a vertical erecting position shown in FIG. 1. Through this, the drill rod element 5 moved by the slide carriage 70 is erected from a horizontal position in the receiving part 20 into an obliquely upward-directed delivery position. To reduce friction on the lifting rod 74 support rollers 76 for the supported drill rod element 5 are rotatably supported in the head region of the said lifting rod.

In this delivery position the erected drill rod element 5 can be seized and gripped by a grab 92 of a handling system 90, as shown in FIG. 1. In the illustrated embodiment the grab 92 is rotatably supported on a carriage 94 that is vertically movable along a rod-shaped vertical guide 96. By way of further guides and bearings, not shown, the vertical guide 96 is movable and rotatable in a generally known manner so that the gripped drill rod element 5 can be transported by the handling system 90 to the drill string on the drill mast 80.

Figure 2:
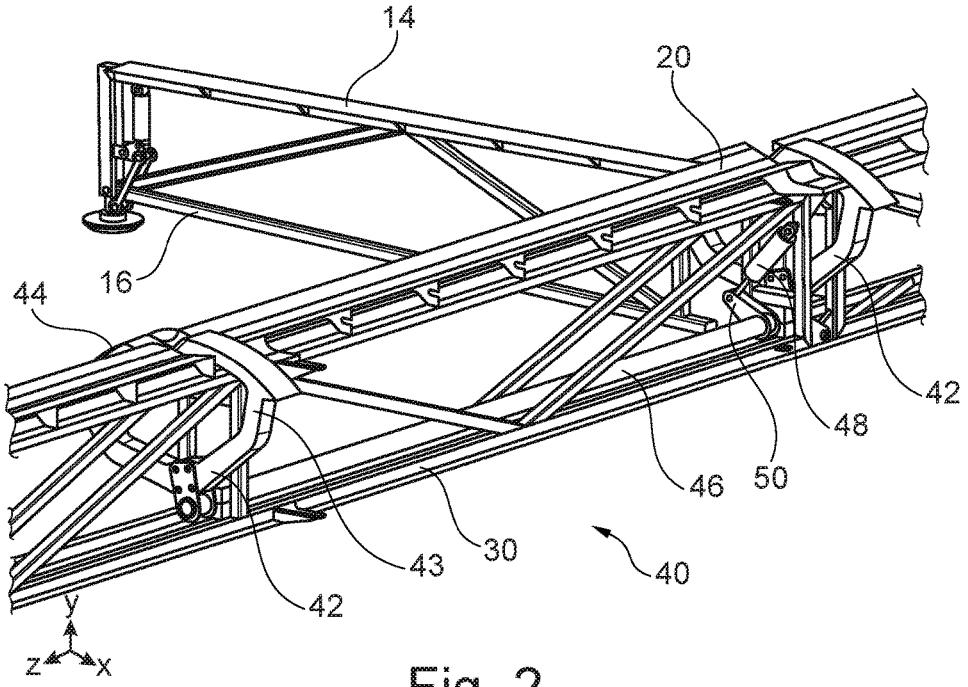
FIG. 2 a perspective detailed view of a supply means on a drill rod store according to the invention.

The structure of the supply means 40 is illustrated in greater detail in FIG. 2. This has two C-shaped pivot brackets 42 which each comprise a first bracket arm 43 and a second bracket arm 44. Below the trough-shaped receiving pad 20 a rod-shaped pivot axis 46 is rotatably supported on the carrier structure 30. At the two ends of the pivot axis 46 a pivot bracket 42 is fixed in each case so that the pivot brackets 42 can be pivoted by means of the pivot axis 46. For pivoting, a hydraulic cylinder is provided as a pivot drive 48 which is fixed on the one hand on a vertical strut of the carrier structure 30 and on the other hand on a lever arm 50 which is in turn firmly connected to the tube-shaped pivot axis 46.

Through retraction and extension of the hydraulic cylinder of the pivot drive 48 the pivot brackets 42 can be pivoted between a central resting position to either side towards the two storage areas 11, 12 into a first transfer position and a second transfer position respectively.

In the following the mode of operation of the supply means 40 will be explained in greater detail in conjunction with FIGS. 3 to 10.

Figure 3:
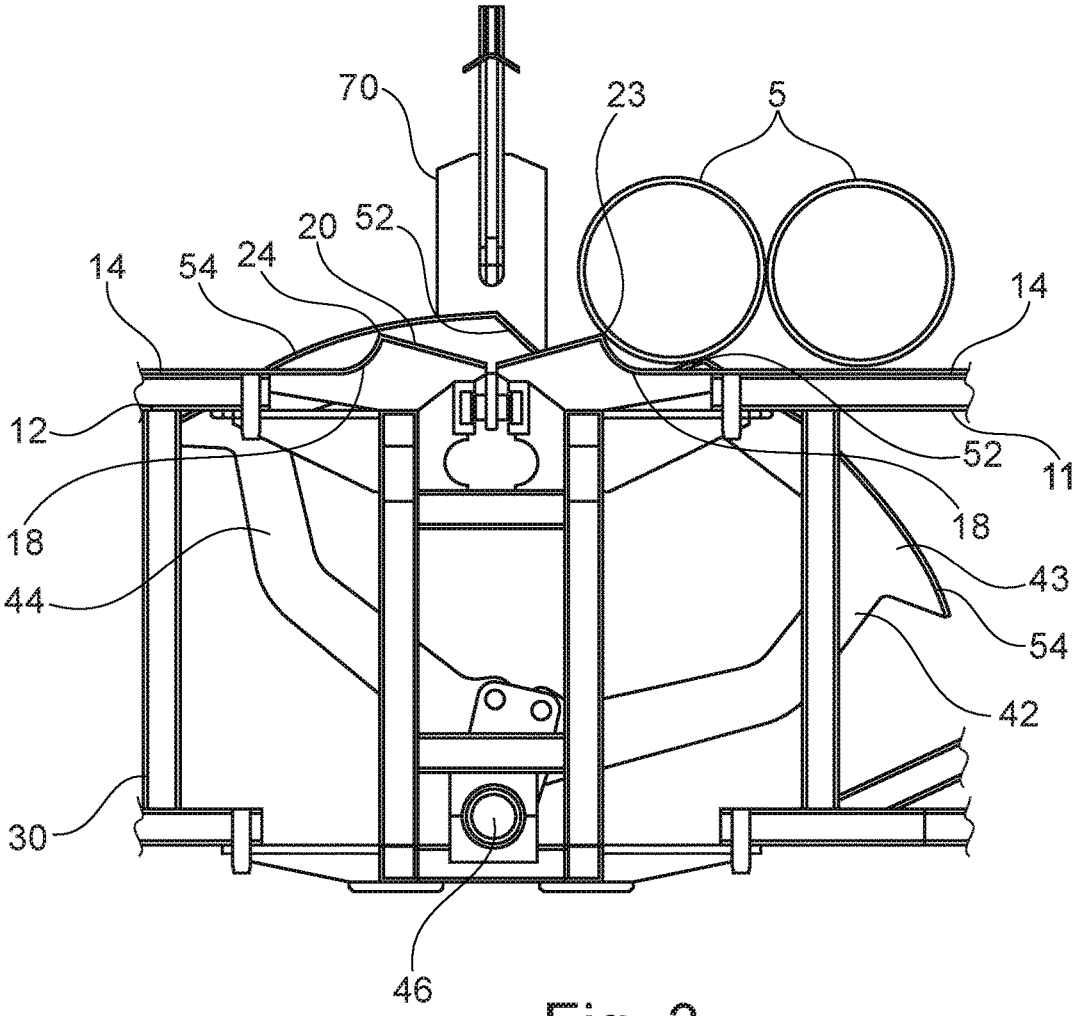
FIGS. 3 to 6 partial front views of the supply means according to FIG. 2 in different operating states during the supply of first drill rod elements.

To supply a drill rod element 5 from the first storage area 11 the pivot brackets 42 are pivoted by the pivot axis 46 from a central resting position towards the first storage area 11, as depicted in FIG. 3. In doing so, a lifting surface 52 on the first bracket arm 43, which is inclined towards the trough-shaped receiving part 20, positions itself underneath a drill rod element 5 which is supported on the support rail 14 in the first storage area 11 and rolls towards the trough-shaped receiving part 20 due to an inclination of the support rail 14. The support rail 14 merges into the V-shaped receiving part 20 by means of an arched rail element 18, with a first marginal edge 23 being formed between the trough-shaped receiving part 20 and the concave arch shape of the rail element 18. This upward-protruding marginal edge 23 prevents the drill rod element 5 as well as further adjoining drill rod elements 5 from rolling from the storage area 11 directly into the trough-shaped receiving part 20.

Accordingly, in the second storage area 12 an arched rail element 18 forming a second marginal edge 24 towards the trough-shaped receiving part 20 is also designed.

Figure 4:
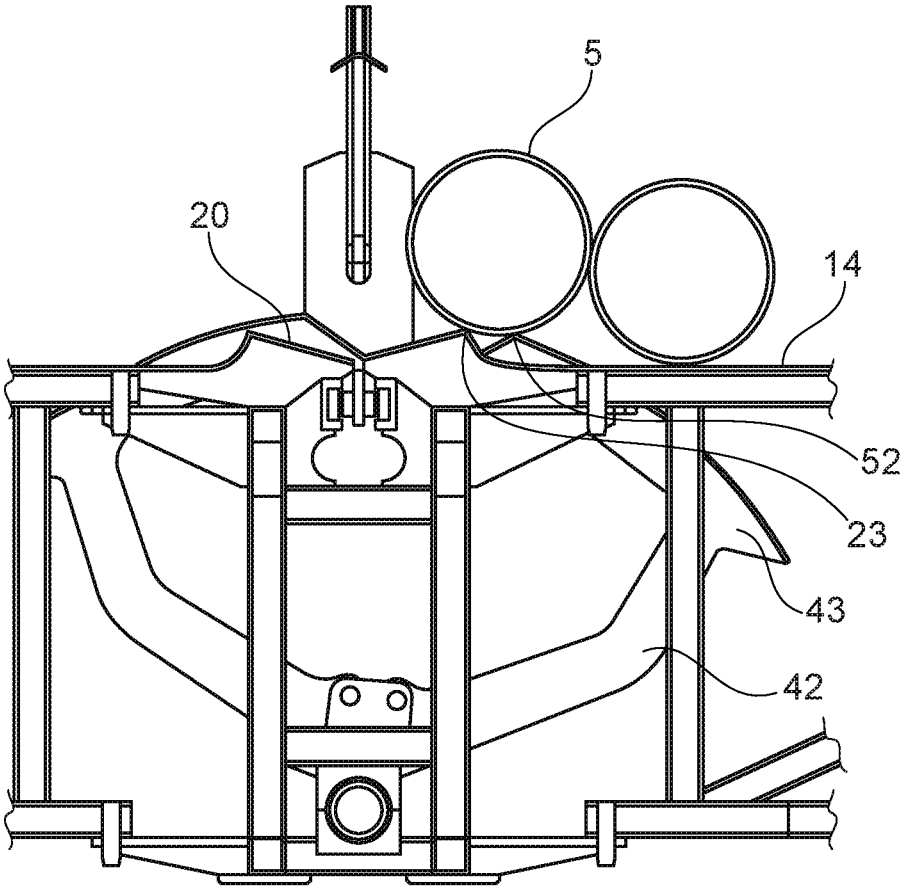

Starting from the receiving position according to FIG. 3 the pivot bracket 42 is now pivoted back into its central position, whereby the drill rod element 5 adjoining the trough-shaped receiving part 20 is raised with respect to the support rail 14 by the lifting surface 52 of the first bracket arm 43 of the pivot bracket 42, as illustrated in FIG. 4.

Figure 5:
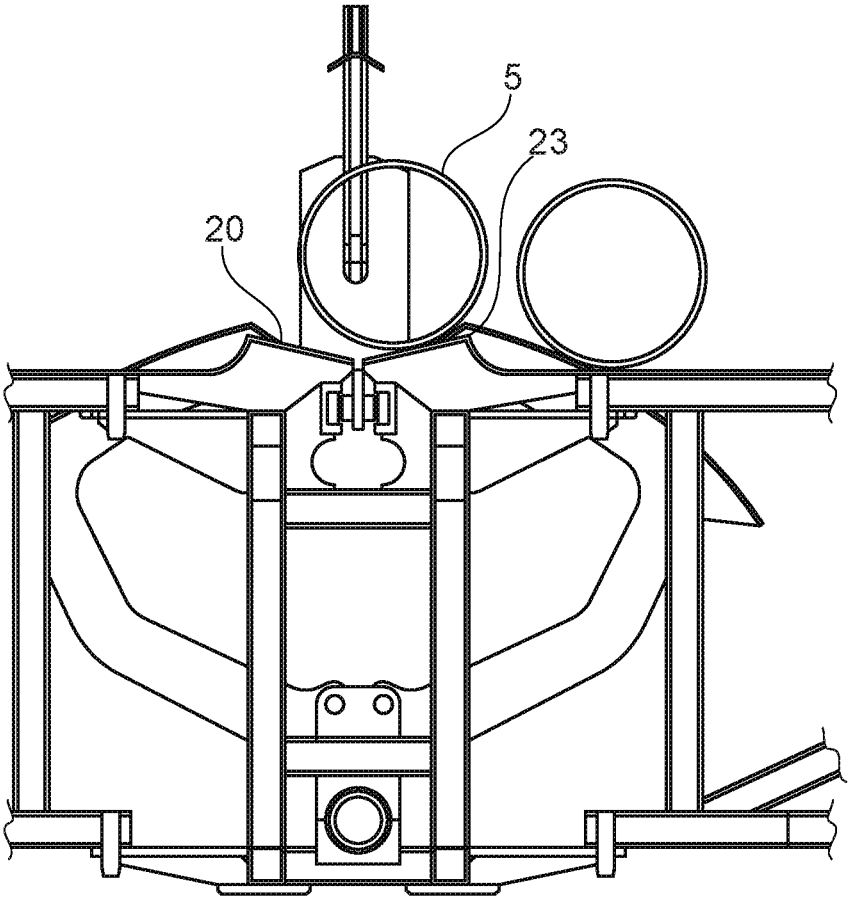
Figure 6:
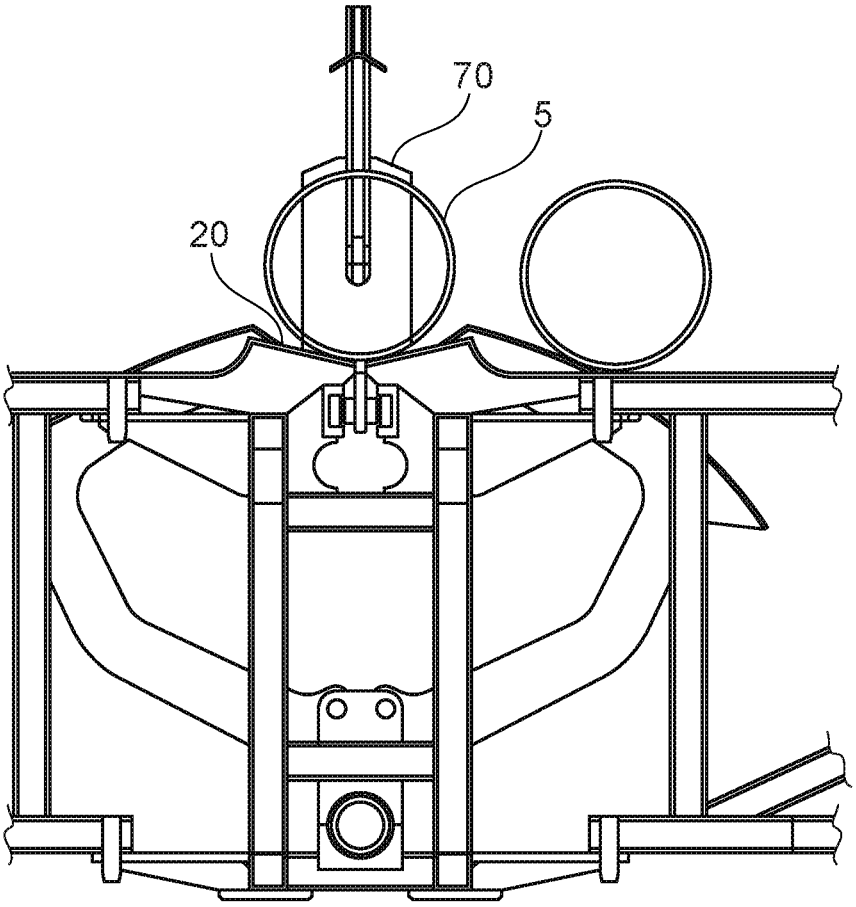

On reaching the central position of the pivot bracket 42 the drill rod element 5 is lifted over the first marginal edge 23 of the trough-shaped receiving part 20. Once this transfer position has been reached, the drill rod element 5 can thus roll into the V-shaped horizontal receiving part 20 into a delivery position, as shown in FIG. 5. In the delivery position according to FIG. 6 the drill rod element 5 is supported in a centered manner in the trough-shaped receiving part 20 and can now be displaced linearly by the slide carriage 70 along the trough-shaped receiving part 20 in the direction of the drill mast 80, as can be taken from FIG. 6.

An enlarged illustration according to FIGS. 7 to 10 shows and explains how second drill rod elements 5 from the second storage area 12 are supplied reliably to the trough-shaped receiving part 20, despite the fact that the drill rod elements 5 have a different diameter as compared to those of the first storage area 11. The second drill rod elements 5 of the second storage area 12 have a smaller diameter than the first drill rod elements 5 in the first storage area 11, as illustrated in conjunction with FIGS. 3 to 6.

Figure 7:
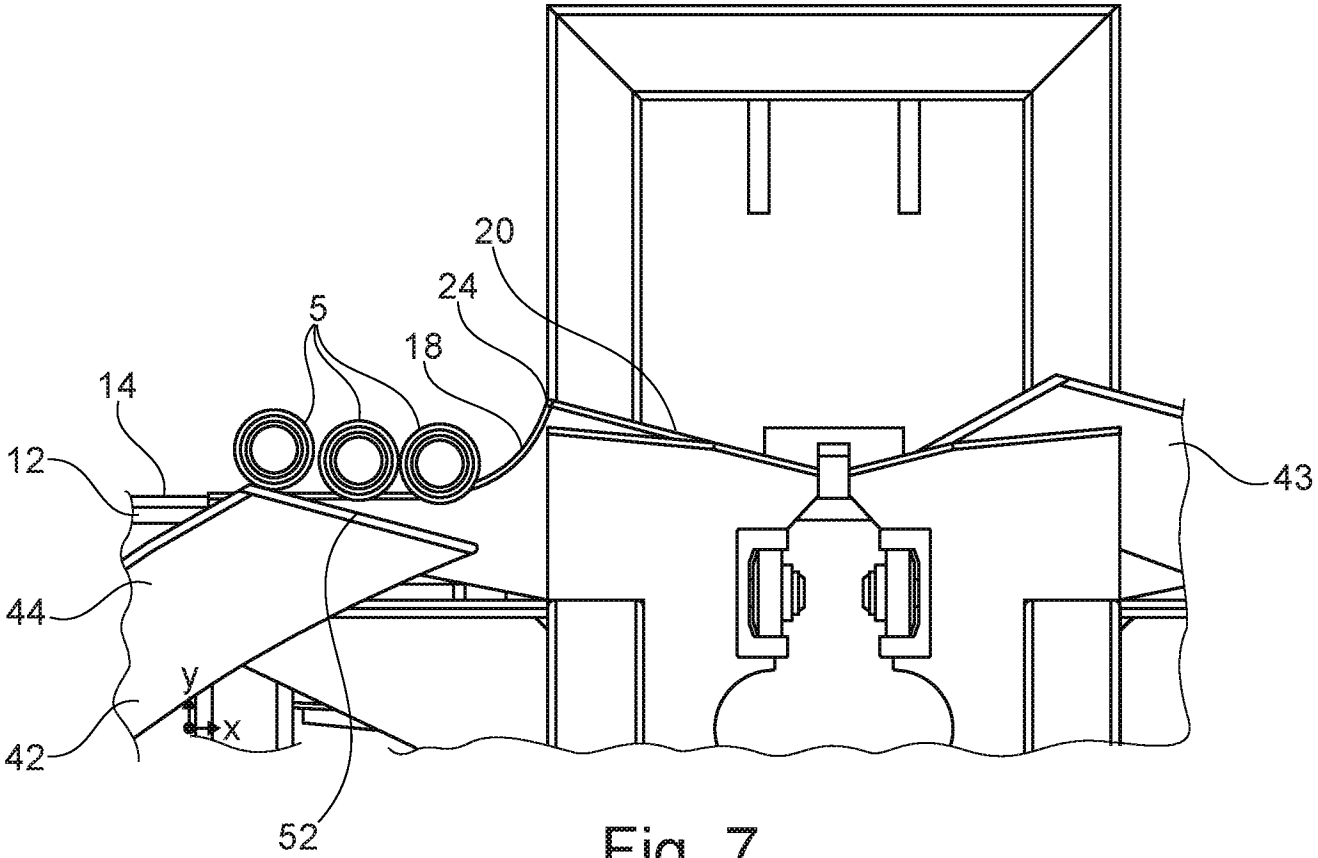
FIGS. 7 to 10 partial front views of the supply means according to FIG. 2 during the supply of second drill rod elements in different operating states.
Figure 8:
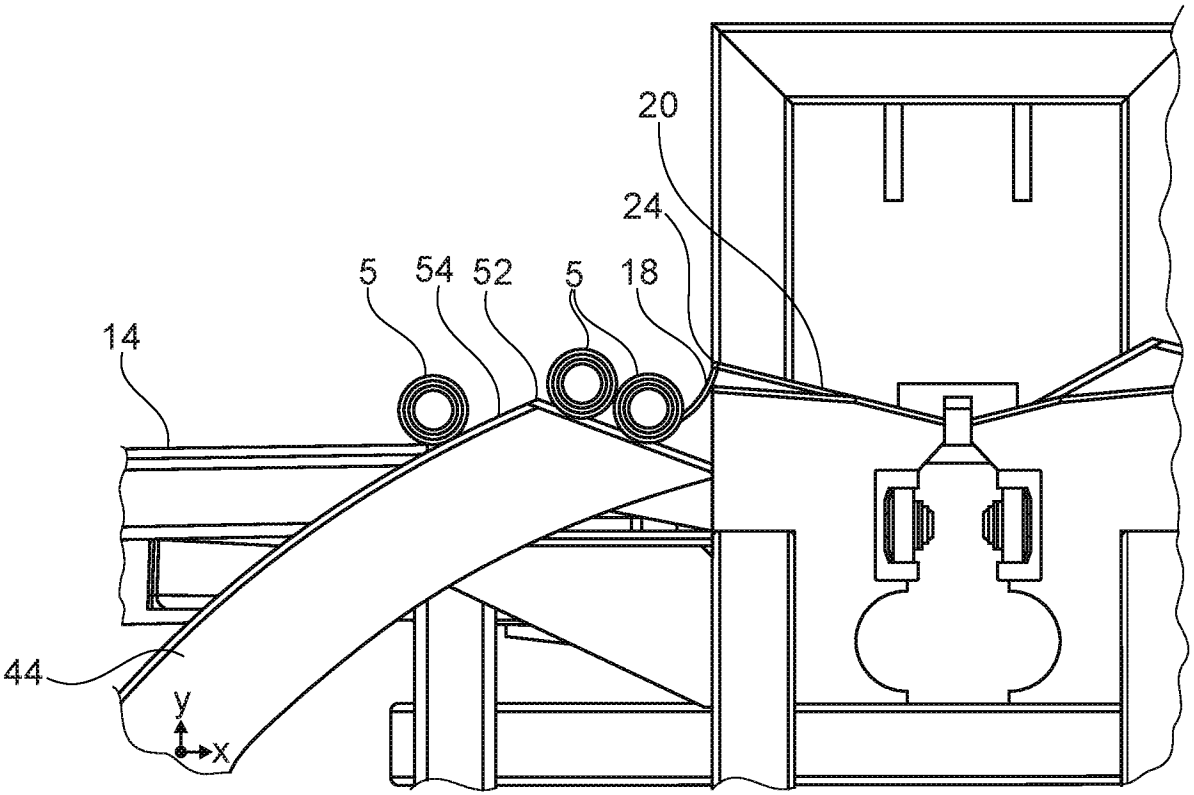

According to FIG. 7 the pivot bracket 42 is located with the first bracket arm 43 and the second bracket arm 44 in a receiving position pivoted towards the second storage area 12. In this position, the lifting surface 52 of the second bracket arm 44 is located below several drill rod elements 5 which are supported on the arched rail element 18 and adjoin the trough-shaped receiving part 20. By pivoting the second bracket arm 44 back into a central resting position of the pivot bracket 42 the drill rod elements 5 are raised and at the same time pushed laterally against the concave outer contour of the arched rail element 18. Due to the limited length of the lifting surface 52 a drill rod element 5 located on the right side is pushed away from the lifting surface 52 towards the right side and rolls across an arched, convex return surface 54 on the second bracket arm 44 back to the support rail 14, as depicted in FIG. 8.

Figure 9:
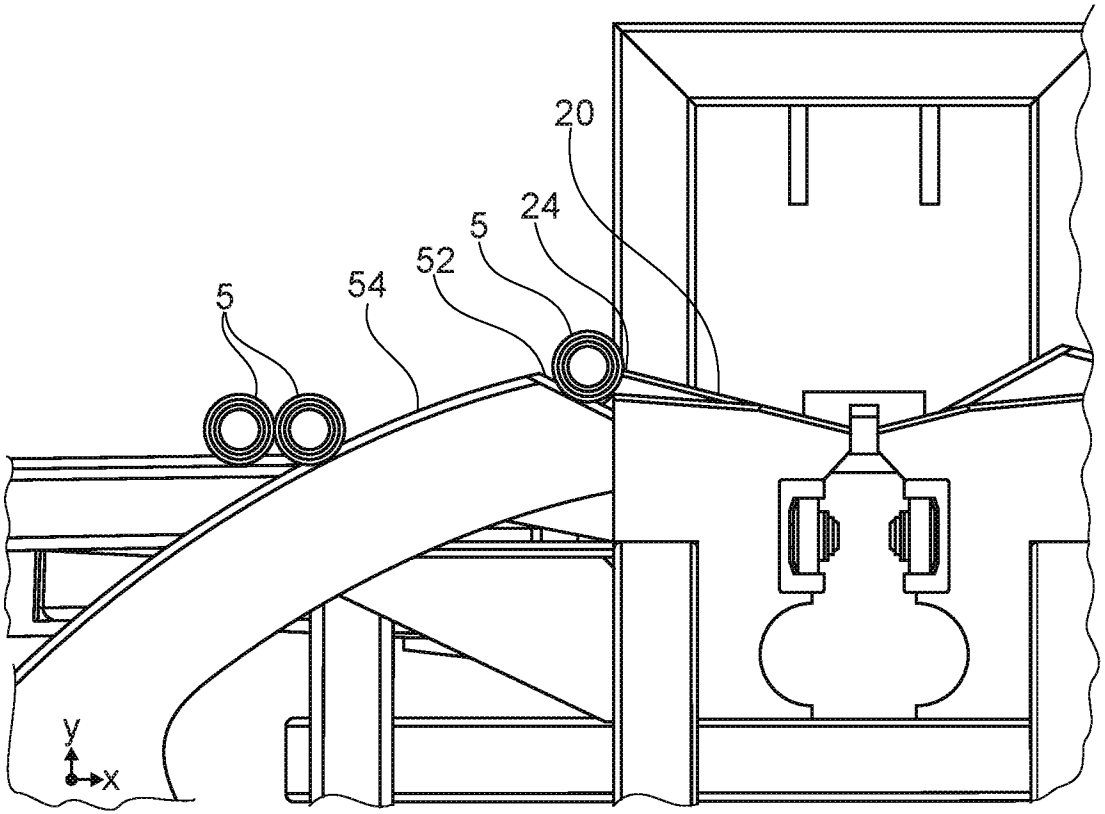

By pivoting the second bracket arm 44 further towards the central position of the pivot bracket 42 the second drill rod element 5 is also pushed laterally to the right side from the lifting surface 52 onto the convex return surface 54 in accordance with FIG. 9. From this return surface 54 the second drill rod element 5 also rolls back onto the support rail 14 of the second storage area 12. In this way, a single drill rod element 5 remains between the lifting surface 52 and the second marginal edge 24 on the lateral margin of the trough-shaped receiving part 20.

Figure 10:
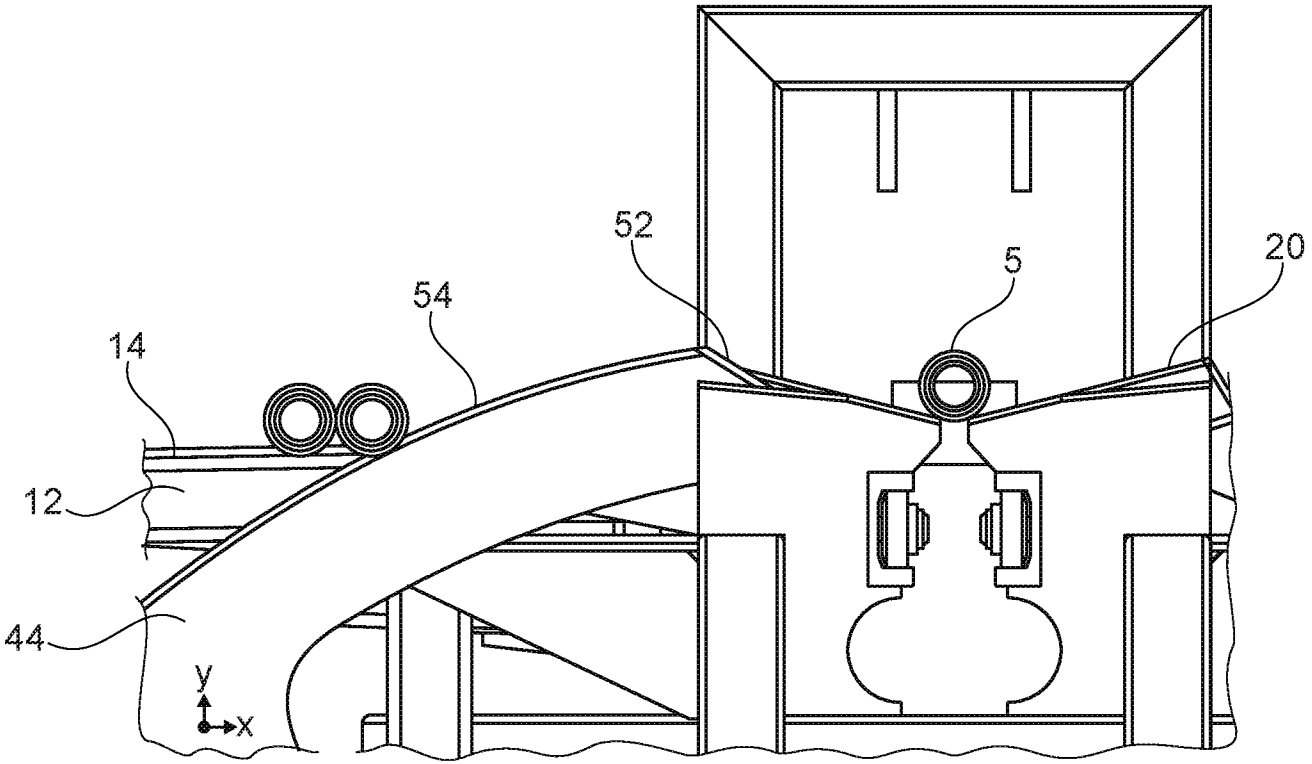

By pivoting the second bracket arm 44 further into the central position the remaining drill rod element 5 is lifted over the second marginal edge 24 so that this drill rod element 5 now rolls into the V-shaped trough of the receiving part 20 into a centered position, as shown in FIG. 10.

It is especially clarified by the operating sequence according to FIGS. 3 to 10 that the drill rod store according to the invention with the supply means for supplying and separating different drill rod elements 5 with varying diameters can be used without any constructive adaptations.

The invention claimed is:

1. A drill rod store comprising:

a first storage area configured to store at least one first drill rod element in horizontal alignment, a second storage area configured to store at least one second drill rod element in horizontal alignment, a trough-shaped receiving part for a single drill rod element of the at least one first drill rod element or the at least one second drill rod element, wherein the trough-shaped receiving part is arranged between the first storage area and the second storage area and is designed to deliver the single drill rod element, and a joint supply means configured to supply one of the at least one first drill rod elements from the first storage area and to supply one of the at least one second drill rod elements from the second storage area to the trough-shaped receiving part, wherein the joint supply means has at least one pivot bracket with a first bracket arm and a second bracket arm, wherein the at least one pivot bracket is supported in a pivotable manner about a pivot axis, which is directed parallel to the trough-shaped receiving part, and wherein the pivot axis of the at least one pivot bracket runs below the trough-shaped receiving part and centrally thereto.

2. The drill rod store according to claim 1, wherein at least one of the first storage area and the second storage area has at least two support rails, which are directed towards the trough-shaped receiving part and configured to support the at least one first drill rod element and the at least one second drill rod element, respectively, parallel to the trough-shaped receiving part.

3. The drill rod store according to claim 2, wherein the support rails are arranged in an inclined manner to the trough-shaped receiving part.

4. The drill rod store according to claim 1, wherein the trough-shaped receiving part has a first lateral marginal edge and a second lateral marginal edge, wherein each of the first storage area and the second storage area has at least two support rails, wherein the first lateral marginal edge is arranged above the support rails of the first storage area, and a first arched rail element of the trough-shaped receiving part is arranged between the support rails of the first storage area and the first lateral marginal edge, and wherein the second lateral marginal edge is arranged above the support rails of the second storage area, and a second arched rail element of the trough-shaped receiving part is arranged between the support rails of the second storage area and the second lateral marginal edge.

5. The drill rod store according to claim 1, wherein the first bracket arm of the at least one pivot bracket has a first lifting surface, which is inclined towards the trough-shaped receiving part and designed to raise the one of the at least one first drill rod element from the first storage area over the first lateral marginal edge of the trough-shaped receiving part, and wherein the second bracket arm of the at least one pivot bracket has a second lifting surface, which is inclined towards the trough-shaped receiving part and designed to raise the one of the at least one second drill rod element from the second storage area over the second lateral marginal edge of the trough-shaped receiving part.

6. The drill rod store according to claim 5, wherein the at least one pivot bracket has a resting position, in which the first lifting surface of the first bracket arm and the second lifting surface of the second bracket arm are arranged below the at least one first drill rod element in the first storage area and the at least one second drill rod element in the second storage area, the at least one pivot bracket can be pivoted from the resting position into a first transfer position, wherein by means of the first lifting surface of the first bracket arm the one of the at least one first drill rod element from the first storage area is raised and lifted over the first lateral marginal edge of the trough-shaped receiving part, and the pivot bracket can be pivoted from the resting position into a second transfer position, wherein by means of the second lifting surface of the second bracket arm the one of the at least one second drill rod element from the second storage area is raised and lifted over the second lateral marginal edge of the trough-shaped receiving part.

7. Drill The drill rod store according to claim 1, wherein each of the first bracket arm and the second bracket arm of the at least one pivot bracket has a return surface, which is inclined to the first storage area and the second storage area, respectively.

8. The drill rod store according to claim 1, wherein the at least one pivot bracket can be pivoted by means of a pivot drive.

9. The drill rod store according to claim 8, wherein the pivot drive is a hydraulic cylinder.

10. The drill rod store according to claim 1, wherein along the trough-shaped receiving part a slide carriage for axial displacement of the single drill rod element is supported and driven in a movable manner.

11. The drill rod store according to claim 1, wherein on the trough-shaped receiving part a lifting rod for raising and erecting the single drill rod element into a delivery position is supported in a pivotable manner.

12. A drilling rig with a drill mast for downward drilling of the single drill rod element, wherein the drill rod store according to claim 1 is provided.

13. A method for downward drilling of the single drill rod element, wherein the drilling rig according to claim 12 is used.

* * * * *